United States Patent [19]

Westfal et al.

[11] Patent Number: 4,977,065

[45] Date of Patent: Dec. 11, 1990

[54] PROCESS FOR THE PRODUCTION OF A SUPPORT MATERIAL FOR LIGHT-SENSITIVE MATERIALS WITH AN ANTI-CURL LAYER

[75] Inventors: Horst Westfal, Osnabruck; Frits B. Ruben, Bohmte, both of Fed. Rep. of Germany

[73] Assignee: Felix Schoeller Jr. GmbH & Co. KG, Fed. Rep. of Germany

[21] Appl. No.: 213,911

[22] Filed: Jun. 30, 1988

[30] Foreign Application Priority Data

Jul. 2, 1987 [DE] Fed. Rep. of Germany ..... 3721808

[51] Int. Cl.[5] ..... G03C 1/76

[52] U.S. Cl. ..... 430/271; 430/531; 430/539; 430/621; 430/930; 427/384; 427/414

[58] Field of Search ..... 430/271, 930, 621, 539, 430/538, 531; 427/384, 414

[56] References Cited

U.S. PATENT DOCUMENTS 4,196,001 4/1980 Joseph et al. ..... 430/502
4,209,584 6/1980 Joseph ..... 430/527
4,233,398 11/1980 Nittel et al. ..... 430/495
4,248,963 2/1981 Kolb et al. ..... 430/501

OTHER PUBLICATIONS

*The Theory of the Photographic Process*, 4th Ed., N.Y., MacMillan Publishing Co., 1977, pp. 77–78.

*Primary Examiner*—Paul R. Michl
*Assistant Examiner*—Mark R. Buscher
*Attorney, Agent, or Firm*—Allegretti & Witcoff

[57] ABSTRACT

There is described a waterproof support material for light-sensitive materials with an anti-curl layer applied in two successive coatings on the reverse side.

With the first coating, gelatin is dried out from the sol form and hardened in such a manner that, after the drying of the first coating, the second coating, which contains additional hardening agent, can be applied immediately without difficulty. Chromium(III)-salts are contained in both coatings as hardening agents.

Through the selected combination of 2 process steps, anti-curl layers of extremely low water absorption capacity are obtained.

16 Claims, No Drawings

PROCESS FOR THE PRODUCTION OF A SUPPORT MATERIAL FOR LIGHT-SENSITIVE MATERIALS WITH AN ANTI-CURL LAYER

BACKGROUND OF THE INVENTION

The invention concerns a process for producing a support material for light-sensitive materials with an anti-curl layer on the reverse side.

THE PRIOR ART

In most photographic materials, gelatin is used for the formation of the silver halogenide emulsions, the protective layers and the reverse side layers. Gelatin layers swell up in water, however, and have little mechanical strength in their swollen state. They are therefore usually hardened by means of suitable hardening agents. The hardening agents cross-link the gelatin molecules with one another, and thereby effect a reduction of the water absorption or swelling capacity of the layer, a raising of the melting point, and an improvement of the mechanical strength of the gelatin layer. Hardened gelatin layers are, above all, resistant to photographic treatment baths.

Gelatin-containing layers on the reverse side of the support material lie opposite the light-sensitive gelatin-containing layers on the forward side of the support material. By using the same binding agent, gelatin, on both sides of the support material, the swelling behavior in the photographic treatment baths and the behavior of the layers during subsequent drying can be kept as identically close to one another as possible, so that, during the entire operational process, as well as during later use, the material maintains a good flat shape. The layers applied to the reverse side are therefore designated as anti-curl layers, and their layer thicknesses depends on the swelling behavior and the layer thickness of the coating on the forward side.

The anti-curl layers generally contain various additives. These can be wetting agents, such as saponin, dulling agents, such as silicic acid, softeners, such as glycerin, organic acids, such as citric acid, small quantities of other water-soluble high polymer compounds, such as polyvinylalcohol, or anti-statics, such as sodium nitrate.

The resistance of the anti-curl layers to the photographic treatment baths is achieved through the hardening of the gelatin with so-called hardening agents.

Among the known hardening agents for gelatin are chromium(III)-salts, aldehyde, dialdehydepolysaccharide, polyfunctional epoxide, aziridine, polyfunctional vinyl compounds, triacrylformal, substituted dichloro-s-triazine and other substances described in chapter 2 of the book, "The Theory of the Photographic Process," by T. H. James (London, 1977).

The hardening agents are either added to the gelatin-containing solutions before processing, or they are applied as a separate solution to the gelatin layer which is already on a support. In the second case, the hardening agents diffuse into the gelatin layer, where they enter into reactions with the peptide chains. Both processes can also be combined with one another in such a manner that a portion of the hardening agent is added to the gelatin solution, and another portion is subsequently applied to the layer.

All substances which are commonly used as hardening agents have, however, a preferably range of use, and are not optimal for other uses. That is to say, all the hardening agents named are affected by one or several disadvantages. Aliphatic aldehyde and diketone are not suited for color photographic layers, because they can enter into reaction with regular color couplers or other emulsion additives. Polyepoxide, triazine and polysaccharide are admittedly good for color photographic layers, but react very slowly and are therefore not suited for such gelatin layers as are to be mechanically stressed after the drying of the layer, such, for example, during another coating process. Other hardening agents, such as chromium salts, for example, are so capable of reaction that a gelatin solution mixed with them has an increase in viscosity even during processing. Again, other hardening agents are not sufficiently diffusion-resistant, and change the hardening condition of adjacent layers during storage.

Every previously known hardening agent therefore has one disadvantage or another, and does not have the broad possibility for use as is desired, above all else, in gelatin auxiliary layers which are applied to a support before emulsion coating, and are later in contact with the actual photographic layers. The principal disadvantage is, however, that the reaction of most hardening agents with gelatin takes place too slowly, and, very frequently, additional processing of the coated material is only possible after days or weeks of interim storage. Chromium(III)-salts likewise, in the known manner, have this subsequent time-dependent drying and aging process (Zeitschrift fur wissenschaftliche Photographie [/=Journal for Scientific Photography/], volume 57, 1963, series 9–12, page 155, paragraph 2, and DOS 24 17 779 [/DOS=German Patent Disclosure Statement/], page 45, paragraph 3).

The use of hardening agents which act rapidly and which do not change their hardening condition during storage are highly desirable. This is also the task of DOS 24 17 779, in which the general problem and the solution is in the form of two layers to be applied in succession, the first of which is a gelatin layer and the second of which is a hardening layer combined with polysaccharides. Organic compounds, which are, however, incompatible with polyvinylalcohol, as described on page 55 of the above DOS, are applied in the covering coating as hardening agents. As an essential characteristic for the evaluation of the hardened layers, the swelling factor is measured after 10 minutes of treatment of a sample strip in distilled water at 22° C. It is defined as follows:

$$\text{Swelling factor} = \frac{\text{Layer weight/wet}}{\text{Layer weight/dry}}$$

According to examples 1 and 2 of DOS 24 17 779, the layer weight (dry) consists of approximately 60 weight % gelatin, which has been hardened. The lowest swelling factors lie, in this disclosure, at 3.0; relative to the gelatin, this means a water absorption of 5 g/1 g gelatin.

Gelatin solutions are generally applied in a warm state to the support material, and then proceed through a gelification zone, in which they are transformed from the sol form into the gelatin form. The layers are dried for the first time after this conversion (Ullmanns Encyklopadie der technischen Chemie [/=Ullmann's Encyclopedia of Technical Chemistry/], 4th edition, volume 18, page 443). This conversion of the gelatin from the sol form into the gel form is an *essential* step. Gelatin solutions can, for example, only be hardened with chromium(III)-salts if they can react in the gel condition. Gelatin sols do not cross-link with chromium(III)-salts (Photographic Science and Engineering, volume 3, number 6, Nov./Dec. 1959, page 277 et seq). The described gelification zone is therefore the state of the art for achieving a high melting range and a high strength of gelatin coatings before the actual drying of the solutions applied. The conversion of the sol form into the gel form generally takes over 2 minutes, in which temperatures of less than 30° C. are necessary. This necessarily requires slow coating machine speeds or long gelification zones.

The water absorption of the gelatin layers from DOS 24 17 779 has certainly been selected correctly for emulsion layers, but it is, however, too high for anti-curl layers applied to the reverse side. The higher the water absorption is, the more gelatin dissolves out of the anti-curl layer and contaminates the photographic treatment baths. Upon obtaining a necessary swelling capacity, which is necessary for disturbance-free passage through the development baths, the water absorption capacity of the anti-curl layer should, however, be as low as possible.

THE INVENTION

It is thus the object of this invention to develop a process for the production of support material for light-sensitive materials with an anti-curl layer on the reverse side, which has a water absorption of <2.5 g water/1 g gelatin, measured after a reaction time of 10 minutes with distilled water at 22° C.

A further object is to dispense, for economical reasons, with a solidification zone in the coating apparatus, and to harden the gelatin solution directly out of the sol form, so that the subsequent time-dependent drying and aging process required in the case of chromium(III)-salts can be avoided.

We have discovered, surprisingly, that chromium-(III)-salt, applied as a separate coating to gelatin layers, which are dried directly out of the sol form, does not lead to the known subsequent time-dependent drying and aging process known in the case of chromium(III)-salts. In accomplishing the objects of the invention, the drying of the first coating begins directly after the application of the layer, without the necessity of converting the sol form of the gelatin into the gel form.

The first coating consists of a gelatin solution which contains hardening agents in a quantity and of a type that makes an immediate additional processing after drying possible, for example, in a tandem process, but is not sufficient for the orderly function of an anti-curl layer, as described above. This solution preferably has a pH value of 6.3–6.9.

Since the application of the second coating preferably takes place immediately after the drying of the first coating, the first coating must, immediately after its drying, have a strength and surface hardness which permits the second coating to be applied and dosed.

If application assemblies, which mechanically strongly stress the surface of the first coating, are used for the application and dosing of the solution of the second coating, then the strength and hardness of the first coating proves to be unsatisfactory. This is the case, for example, if rolling wipers are used for the dosing.

It has been shown that glyoxal has an accelerating effect on the hardening with chromium(III)-salts, so that, in one special form of the process in accordance with the invention, the hardener combination for the first coating comprises chromium(III)-salt and glyoxal in the ratio of 1:3 to 3:1. Using this combination, the gelatin is so rapidly prehardened that the second coating solution can be applied free of disturbance in tandem coating machines directly after the drying of the first coating solution.

Through the sequence of process steps in accordance with the invention, it is first possible to so harden the surface of anti-curl layers, which comes into contact with the photographic treatment baths, that water absorption of <2.5 g water/1 g gelatin are achieved. At the same time, the hardened gelatin layer remains so elastic at a depth that no embrittlement cracks arise, and the flat layer of the entire support material is maintained.

The elasticity of the anti-curl layer can still be further increased through the fact that softeners, such as glycerin, glycole, sorbite, montmorillonite, and others, are added to the first coating.

Additional hardening agents for the first coating can be substances known in the art to be suited for photographic processes. These may be used in combination with chromium(III)-salt or chromium(III)-salt and glyoxal, if so dosed that the overall system reacts rapidly and intensively enough. One preferred form of the chromium(III)-salts is chrome alum, $KCr(SO_4)_2 \cdot 12 H_2O$.

In the first coating, the hardening agent mixture of chromium(III)-salt: glyoxal=3:1 to 1:3, in an additional quantity of 0.06 weight % to 0.18 weight % $Cr^{3+}$ relative to gelatin, has proven particularly well adjusted to the second coating which contains chromium(III)-salt. With this recipe for the first coating, both layers can also be applied in sequence in a tandem coating machine with roller application and wiper dosing.

The second coating solution contains chromium(III)-salts, chrome alum being preferred. The concentration of this solution is chromium(III)-salt preferably lies between approximately 0.5 weight % and approximately 5 weight %, and depends on the applied layer thickness, which is predetermined by the technical mechanical apparatus, by the rheology of the solution, and by the type of chromium salt.

The total content of chromium(III)-ions in the anti-curl layer should, in accordance with the invention, be higher than 20 mg $Cr/m^2$, and more than half of the quantity is applied in the second coating. As opposed to the representation of DOS 24 17 779, page 55, it is possible, and indeed advantageous, if polyvinylalcohol is added to this hardener solution. The addition of a completely saponified polyvinylalcohol improves the rheological behavior of the hardener solution, allows the layer thickness to be better adjusted, and makes the wetting flawless, so that a more precisely rectilinear edge course of the wet application is possible.

The usual auxiliary agents, such as are known in anti-curl layers on the reverse side of support materials for light-sensitive materials, can also be contained in the anti-curl layer in accordance with the invention, and they are preferably added to the first coating solution.

SPECIFIC EXAMPLES

The specific examples that follow should clarify the various forms of execution.

EXAMPLE I

A support material consisting of 175 g/m² of paper and one layer of 35 g/m² polyethylene on each side was coated with a first coating with the following composition:

| Ingredient | Weight % |
|---|---|
| Water | 84.75 |
| Gelatin | 12 |
| Sodium nitrate | 1 |
| Silicic acid | 1 |
| Glycerin | 1 |
| Wetting agent | 0.1 |
| Citric acid | 0.02 |
| Chrome alum | 0.1 |
| Triacryloylhexahydrotriazine | 0.03 |

Caustic soda solution to produce pH of 6.6.

This first coating applied to the reverse side was dried in the hot air channel; the application weight amounted to 6.0 g/m².

One of the following second coating was applied to this first coating directly after its drying. Examples 1*e* to 1*h* are for purposes of comparing to the invention.

| | | |
|---|---|---|
| (a) | 1 weight % | $KCr(SO_4)_2.12\ H_2O$ (chrome alum). |
| | 1 weight % | Polyvinylalcohol (PVA), completely saponified, average degree of polymerization = 5100. |
| | 98 weight % | Water. |
| (b) | 3 weight % | Chrome alum. |
| | 1 weight % | PVA, as in (1a). |
| | 96 weight % | Water. |
| (c) | 5 weight % | Chrome alum. |
| | 1 weight % | PVA, as in (1a). |
| | 94 weight % | Water. |
| (d) | 5 weight % | Chrome alum. |
| | 95 weight % | Water. |
| (e) | 5 weight % | Formaldehyde. |
| | 95 weight % | Water. |
| (f) | 5 weight % | Sodium salt of the 2-hydroxy-4.6-di-chloro-s-triazine. |
| | 95 weight % | Water. |
| (g) | 5 weight % | Glyoxal. |
| | 95 weight % | Water. |
| (h) | 5 weight % | Mucochloric acid. |
| | 95 weight % | Water. |

The second coating, applied to the reverse side, was dried in the hot air channel. The application weight amounted to:

(a) 180 mg/m²
(b) 260 mg/m²
(c) 320 mg/m²
(d) 280 mg/m²
(e) 280 mg/m²
(f) 280 mg/m²
(g) 265 mg/m²
(h) 270 mg/m²

The machine speed during both applications was 100 m/min.

EXAMPLE 2

The support material from Example 1 was used. The composition of the recipe of the first coating was modified in the following manner:

| Basic Recipe: Ingredient | Weight % |
|---|---|
| Gelatin | 12 |
| Sodium nitrate | 1 |
| Silicic acid | 3 |
| Glycerin | 1 |
| Wetting agent | 0.1 |
| Citric acid | 0.02 |

Additional additives in weight %:

| | Chrome alum | Chromium(III) chloride-6-hydrate | Triacryl-hexahydro-triazine | Formal-dehyde | Glyoxal |
|---|---|---|---|---|---|
| a | 0.09 | — | — | — | 0.09 |
| b | 0.045 | — | — | — | 0.045 |
| c | 0.045 | — | — | — | 0.135 |
| d | 0.135 | — | — | — | 0.045 |
| e | — | 0.09 | — | — | 0.09 |
| f | 0.045 | — | 0.03 | — | — |
| g | — | — | — | 0.045 | 0.09 |

Additional additives in weight %:

| | Chrome alum | Chromium(III) chloride-6-hydrate | Triacryl-hexahydro-triazine | Formal-dehyde | Glyoxal |
|---|---|---|---|---|---|
| a | 0.09 | — | — | — | 0.09 |
| b | 0.045 | — | — | — | 0.045 |
| c | 0.045 | — | — | — | 0.135 |
| d | 0.135 | — | — | — | 0.045 |
| e | — | 0.09 | — | — | 0.09 |
| f | 0.045 | — | 0.03 | — | — |
| g | — | — | — | 0.045 | 0.09 |

In every case, water is added up to 100 weight %.

The pH-value was adjusted to pH=6.6 (NaOH). The first coating applied to the reverse side was dried in the hot air channel; and the application weight amounted to 8.5 g/m².

A solution in accordance with Recipe (1*b*) was was applied as a second coating to this first coating, directly after drying the first coating. The second coating was then dried in the hot air channel.

The machine speed for both applications was 100 m/min.

| Examples | First Coating: Hardener, relative to gelatin: (Weight %) | Chromium(III) ions, relative to gelatin: (Weight %) | Chromium (III)-ions: (mg/m²) | Second Coating: Chromium (III)-ions: (mg/m²) | Total Content: Chromium (III)-ions: (mg/m²) |
|---|---|---|---|---|---|
| 1a | 1.1 | 0.09 | 4.1 | 9 | 13 |
| b | 1.1 | 0.09 | 4.1 | 20 | 24 |
| c | 1.1 | 0.09 | 4.1 | 28 | 32 |
| d | 1.1 | 0.09 | 4.1 | 29 | 33 |
| e | 1.1 | 0.09 | 4.1 | 0 | 4 |
| f | 1.1 | 0.09 | 4.1 | 0 | 4 |
| g | 1.1 | 0.09 | 4.1 | 0 | 4 |
| h | 1.1 | 0.09 | 4.1 | 0 | 4 |

-continued

| Examples | First Coating: Hardener, relative to gelatin: (Weight %) | Chromium(III) ions, relative to gelatin: (Weight %) | Chromium (III)-ions: ($mg/m^2$) | Second Coating: Chromium (III)-ions: ($mg/m^2$) | Total Content: Chromium (III)-ions: ($mg/m^2$) |
|---|---|---|---|---|---|
| 2a | 1.5 | 0.08 | 4.6 | 19 | 24 |
| b | 0.8 | 0.04 | 2.3 | 19 | 21 |
| c | 1.5 | 0.04 | 2.3 | 19 | 21 |
| d | 1.5 | 0.12 | 6.9 | 19 | 26 |
| e | 1.5 | 0.15 | 8.6 | 19 | 28 |
| f | 0.6 | 0.04 | 2.3 | 19 | 21 |
| g | 0.8 | 0.00 | 0.00 | 19 | 19 |

Results of the Examination

The water absorption, relative to the quantity of gelatin in the anti-curl layer, was determined by gravimetric evaluation after 10 minutes' treatment of a sample strip in distilled water, at 22° C., with subsequent drying.

| Examples: | Water Absorption Immediately: | After 4 Weeks: |
|---|---|---|
| 1a | 3.9[1] | 3.3[1] |
| 1b | 1.8 | 1.7 |
| 1c | 0.9 | 1.0 |
| 1d | 0.9 | 1.0 |
| 1e, comparison | 2.9 | 2.6 |
| 1f, comparison | 3.6 | 2.8 |
| 1g, comparison | 2.8 | 2.3 |
| 1h, comparison | 3.1 | 2.6 |
| Comparative example from the literature (from DOS 24 17 779) | 5.0 | |

The second coating can be applied onto the first coating in a disturbance-free manner, by means of rollers and air brushes. Upon using a wire wiper for the dosing of the solution of the second coating, wiper streaks developed.

| Examples: | Water Absorption Immediately: | After 4 Weeks: |
|---|---|---|
| 2a | 0.8 | 0.8 |
| 2b | 2.3 | 2.4 |
| 2c | 2.1 | 2.0 |
| 2d | 0.6 | 0.6 |
| 2e | 0.5 | 0.6 |
| 2f | 2.4 | 2.3 |
| 2g, comparison | 3.0 | 2.6 |

[1]The cause of the relatively high values is the insufficient quantity of chromium(III)-ions in the second coating.

1 The cause of the relatively high values is the insufficient quantity of chromium(III)-ions in the second coating.

The second coating could be applied, in examples 2*a* to 2*e*, in a problem-free manner by means of rollers and air brushes. Examples 2*f* and 2*g* could only be produced with difficulty.

When using a wire wiper for dosing the solution of the second coating, slight wiper streaks appeared in examples 2*b* and 2*c*, and, in examples 2*f* and 2*g*, they could no longer be produced. Only examples 2*a*, 2*d*, and 2*e* produced no problems, even when dosing by means of a wire wiper.

What is claimed is:

1. A process for the production of a support material for light-sensitive materials with an anti-curl layer of gelatin on the reverse side of the support material, comprising applying to the support material a first coating, containing protein-containing binding agents and hardening agents, of which at least one component is a chromium(III)-salt, drying said first coating in the sol form without prior solidification, applying over said dried first coating a second gelatin-free coating solution containing a hardening agent, which contains a chromium(III)-salt, and drying the second coating.

2. A process in accordance with claim 1, characterized in that said second coating solution containing the hardening agent also contains a completely saponified polyvinylalcohol.

3. A process in accordance with claim 1, characterized in that said first coating contains as hardening agents, besides chromium(III)-salts, additional organic compounds, inorganic compounds, or a mixture of both.

4. A process in accordance with claim 1, characterized in that the first coating contains glyoxal in a mass ratio of chromium(III)-salt : glyoxal = 3:1 to 1:3.

5. A process in accordance with claim 1 or 3, characterized in that the concentration of hardening agent in said first coating is 0.5 to 2.0 weight % of the quantity of gelatin.

6. A process in accordance with claim 1 or 3, characterized in that the hardening agent in said first coating contains 0.06 to 0.18 weight % $Cr^{3+}$, relative to the quantity of gelatin.

7. A process in accordance with claim 2, characterized in that the chromium(III)-salt is chrome alum of the formula $KCr(SO_4)_2 \cdot 12\ H_2O$.

8. A process in accordance with claim 1, characterized in that the weight of said first coating lies between 1.0 and 10 $g/m^2$ after drying.

9. A process in accordance with claim 1 or 4, characterized in that said first coating contains, as additives, dulling agents, anti-static agents and/or wetting agents.

10. A process in accordance with claim 1, characterized in that said first coating contains a softener.

11. A process in accordance with claim 3, said organic compound is an organic acid which can form complexes with chromium ions.

12. A process in accordance with claim 1 characterized in that said first coating has a pH-value of 6.3 to 6.9.

13. A process in accordance with claim 2, characterized in that the mass ratio of chromium(III)-salt : the (completely saponified) polyvinylalcohol = 1:1 to 30:1.

14. A process in accordance with claim 8, characterized in that the weight of the second coating after drying lies between 0.1 and 1.0 $g/m^2$.

15. A support material for light-sensitive materials having an anti-curl layer on one side thereof, produced in accordance with the process of claim 1, characterized in that said anti-curl layer has a content of chromium-(III)-ions which is higher than 20 mg $Cr/m^2$.

16. A process for producing a non-curling, non-brittle photographic support material having an anti-curl layer of gelatin on the reverse side thereof characterized by a water absorption of $<2.5$ g/g of gelatin comprising applying to said support material a first coating solution of gelatin containing glyoxal and chromium-(III)-salt in the ratio of 3:1 to 1:3, said solution having a pH=6.3 to 6.9;

drying said first coating in the sol form;

applying a second coating to said dried first coating, said second coating comprising an aqueous solution of 1–5 weight % chrom alum and about 1 weight % of completely-saponified polyvinylalcohol;

the total chromium(III)-ions in said first and second layers having $>20$ mg/$m^2$; and drying said second coating.

* * * * *